US006223357B1

(12) United States Patent
Claas

(10) Patent No.: US 6,223,357 B1
(45) Date of Patent: May 1, 2001

(54) VACUUM TOILET

(75) Inventor: Oliver Claas, Wedel (DE)

(73) Assignee: Sanivac Vakuumtechnik GmbH, Wedel (DE)

( * ) Notice: Subject to any disclaimer, the term of this patent is extended or adjusted under 35 U.S.C. 154(b) by 0 days.

(21) Appl. No.: 09/341,224

(22) PCT Filed: Jan. 10, 1998

(86) PCT No.: PCT/EP98/00120

§ 371 Date: Jul. 7, 1999

§ 102(e) Date: Jul. 7, 1999

(87) PCT Pub. No.: WO98/32929

PCT Pub. Date: Jul. 30, 1998

(30) Foreign Application Priority Data

Jan. 22, 1997 (DE) ..... 297 00 985

(51) Int. Cl.[7] ..... E03D 11/00
(52) U.S. Cl. ..... 4/431; 4/427; 4/420
(58) Field of Search ..... 4/431, 427, 591, 4/420

(56) References Cited

U.S. PATENT DOCUMENTS

| | | | | |
|---|---|---|---|---|
| 108,146 | * | 10/1870 | Ivers | 4/420 |
| 2,778,029 | | 1/1957 | Young . | |
| 3,956,776 | | 5/1976 | Vanden Brock . | |
| 4,063,315 | * | 12/1977 | Carolan et al. | 4/431 |
| 4,164,049 | * | 8/1979 | Michael | 4/431 |
| 5,495,626 | * | 3/1996 | Lindroos et al. | 4/431 |
| 5,732,417 | * | 3/1998 | Pondelick et al. | 4/427 |
| 6,012,678 | * | 1/2000 | Hale et al. | 4/431 |

FOREIGN PATENT DOCUMENTS 2054688 2/1981 (GB) .

* cited by examiner

*Primary Examiner*—Henry J. Recla
*Assistant Examiner*—Khoa Huynh
(74) *Attorney, Agent, or Firm*—Venable; John P. Shannon

(57) ABSTRACT

A vacuum toilet comprising a bowl with flushing nozzles, a shut-off valve and a waste pipe. Connected in the lower region of the bowl is a pipe (12) which leads from the latter upwards and terminates open at a level (H2) slightly below the flushing nozzles (11).

2 Claims, 1 Drawing Sheet

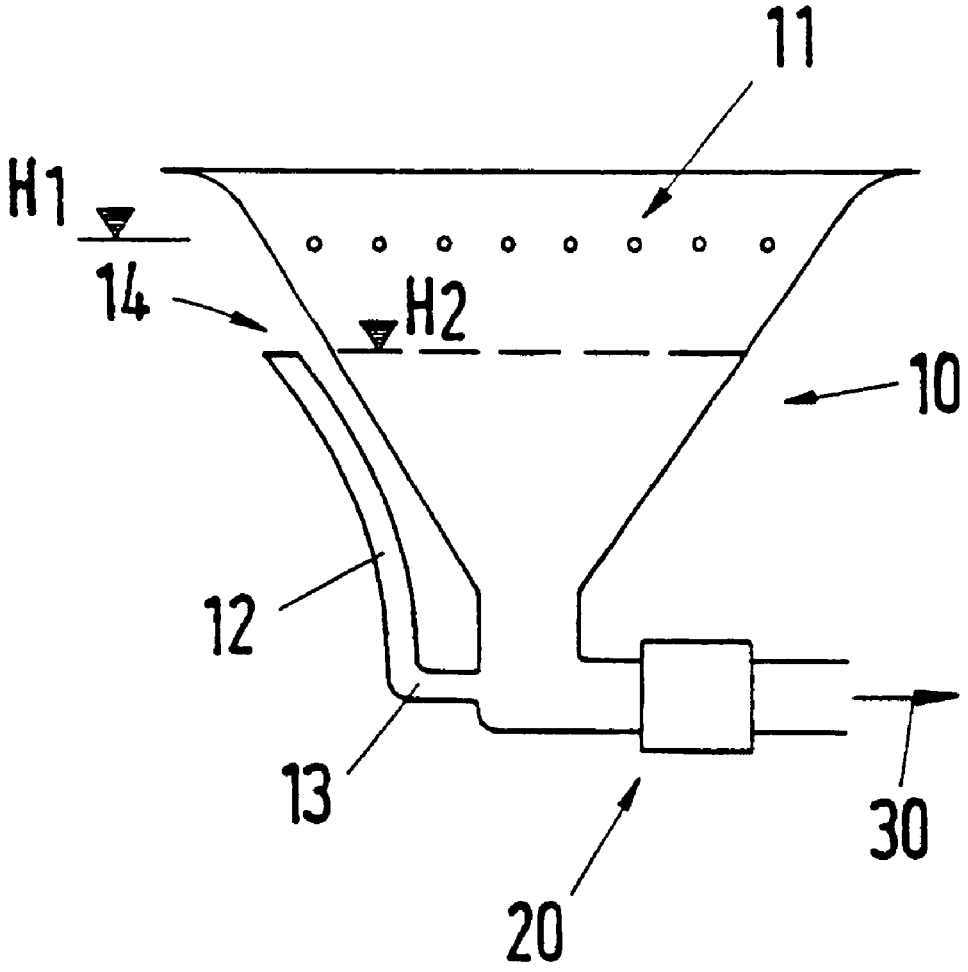
11
H1
14
H2
10
12
13
30
20

VACUUM TOILET

BACKGROUND OF THE INVENTION

The invention relates to a vacuum toilet comprising a bowl with flushing nozzles mounted in the upper area of the bowl and a shutoff valve in the waste pipe connected in the lower area of the bowl.

In vacuum toilets of this type operating conditions may occur which are highly undesirable and in some cases may have disastrous consequences.

If, for example, delivery of flushing water to the flushing nozzles is not shut off because of an error of some nature, the flushing water flows into the bowl and cannot drain downwards, since the shutoff valve is closed. In this instance the water level in the bowl rises and a situation may finally arise in which the flushing nozzles come in contact with the waste water in the bowl, with the result that undesirable contact of more or less polluted waste water to the fresh water circulation may occur; for example, should a defect in the fresh water system cause suction to occur, polluted water from the toilet could reach the fresh water system. But this must be prevented. The safety measure applied in this case would be installation of a separate flushing water circuit in addition to the fresh water circuit, that is, a relatively cost intensive measure.

It is also conceivable that, in instances of improper use of state-of-the-art vacuum toilets, in particular ones used in aircraft, for which the negative pressure outside an airplane flying at a high altitude is used as a means of conveyance, the suction action of the vacuum might draw in objects or human body parts so that the danger of damage to objects and of serious physical injury exists.

SUMMARY OF THE INVENTION

The invention concerns itself with such defects of state-of-the-art vacuum toilets and provides an effective remedy in that, in a vacuum toilet of the type described in the foregoing, in the lower area of the bowl or in the outlet area a pipe leading to the exterior terminates at a level somewhat lower than that of the flushing nozzles and is open toward the outside.

Because of the connection of the pipe so as to communicate, the highest possible water level in the bowl can be determined by positioning the end of this pipe at the desired geodetic height. Hence, if the flushing nozzles deliver additional water to the bowl with the valve closed, the worst case which may occur is that the flushing water is discharged through the pipe open at its upper end. In no event can the level of the water in the bowl reach the level of the nozzles, and so impairment of the fresh water circuit is excluded.

In the suction process of the vacuum toilet claimed for the invention the vacuum source affects the liquid present in the piping as well as the mass in the bowl. The mass flushed and the liquid are drawn by the suction force of the vacuum and, after the piping has been emptied, air is drawn in, so that in no event, as for example in use of the toilet without a toilet seat and conceivably complete sealing off of the edge of the bowl by the body of the person using the toilet, can a suction effect be generated in the bowl such that body parts or objects might be drawn in.

To be added is that the mass drawn in is in a way fluidized by sizing of this additional pipe which is suitable from the viewpoint of internal diameter or a throttle point, so that on the whole the situation during vacuum removal is rendered more favorable.

The invention is described in what follows with reference to the drawing of an example.

BRIEF DESCRIPTION OF THE DRAWING

The sole FIGURE in the drawing presents a diagram of a vacuum toilet in vertical section.

DETAILED DESCRIPTION OF THE PREFERRED EMBODIMENT

In the drawing 10 designates the bowl of a vacuum toilet. In the lower area of the bowl is a suction line which may be shut off by a valve 20. The arrow 30 indicates the direction of delivery of the waste mass and accordingly the action of the vacuum force.

In the upper area of the bowl are a plurality of flushing nozzles 11, which are positioned at a geodetic height H1 and whose significance and purpose are known. Regulations require that these flushing nozzles 11 not come in contact with the water accumulating in the bowl 10; this is a requirement compliance with which cannot be ensured, as has already been pointed out.

In the lower area of the bowl 10, for example in the piping and in any event upstream from the shutoff vale 20, there is connected a pipe 13 which extends upward in an area 12 and ultimately terminates, its end 14 open outward, at a height H2.

It is to be seen that no level of liquid in the bowl can rise beyond the geodetic height H2, since in this instance water can drain off by way of the pipe 12 and the open end 14.

What is claimed is:

1. A vacuum toilet comprising:

a bowl having an upper area and a lower area;

flushing nozzles mounted in said upper area of the bowl; and a waste pipe connected in the lower area of the bowl; and a shutoff valve positioned in the waste pipe, a vacuum force acting on the waste pipe in a direction downstream from the shutoff valve, characterized in that a vent pipe (12) to prevent a reduction of pressure in said bowl below the atmospheric pressure around the bowl is connected in the lower area of the bowl, said vent pipe (12) extending from the lower area upward and terminating in an open end located outside of said bowl so that air from the atmosphere around the bowl flows into the bowl when the pressure in the bowl drops below the atmnosheric pressure, and said vent pipe open end located at a height (H2) below the height of the flushing nozzles (11).

2. The vacuum toilet of claim 1, wherein the open upper end of the vent pipe is outside the bowl.

* * * * *